US005123641A

United States Patent [19]

Abboudi et al.

[11] Patent Number: 5,123,641

[45] Date of Patent: Jun. 23, 1992

[54] APPARATUS FOR UNDERWATER EXERCISE

[75] Inventors: Shalom Y. Abboudi, Highland Park; Mark Williams, New Brunswick, both of N.J.; Frank Alberino, Hamden; Robert Adley, Madison, both of Conn.

[73] Assignee: Water Products Research Co., Metuchen, N.J.

[21] Appl. No.: 466,871

[22] Filed: Jan. 18, 1990

[51] Int. Cl.[5] ..... A63B 22/02

[52] U.S. Cl. ..... 482/54; 482/58; 482/111; 472/128; 416/54

[58] Field of Search ..... 272/1 B, 70, 69, 71, 272/73, 116, 130, DIG. 4

[56] References Cited

U.S. PATENT DOCUMENTS

| | | | |
|---|---|---|---|
| 3,485,213 | 12/1969 | Scanlon | 272/69 X |
| 3,809,003 | 5/1974 | Foldvari | 272/69 X |
| 4,332,217 | 6/1982 | Davis | 272/69 X |
| 4,342,452 | 8/1982 | Summa | 272/69 |
| 4,712,788 | 12/1987 | Gaudreau, Jr. | 272/69 |
| 4,776,581 | 10/1988 | Sheperdson | 272/69 X |
| 4,784,385 | 11/1988 | D'Angelo | 272/116 X |
| 4,938,469 | 7/1990 | Crandell | 272/69 |
| 4,944,506 | 7/1990 | Keller et al. | 272/69 |

FOREIGN PATENT DOCUMENTS

| | | | |
|---|---|---|---|
| 1960373 | 7/1970 | Fed. Rep. of Germany | 272/73 |
| 2818020 | 11/1979 | Fed. Rep. of Germany | 272/73 |
| 2347062 | 12/1977 | France | 272/73 |

*Primary Examiner*—Robert Bahr

*Attorney, Agent, or Firm*—Henry I. Schanzer; Michael Y. Epstein

[57] ABSTRACT

Underwater exercise apparatus includes at least one paddle, which is coupled to an axle causing the paddle to rotate in response to rotation of the axle. When under water, the paddle produces resistance to the rotation of the axle. In a preferred embodiment, the paddle may be made part of a treadmill for underwater use for varying the resistance to movement of the treadmill belt. In a treadmill embodying the invention, the axle of one of the rollers supporting the belt, which roller is tightly coupled to the belt, extends beyond the side edge of the belt. Directly connected to the extending end of the axle, for rotation therewith, is a paddle. In use, movement of the belt causes rotation of the paddle through the water. The water resists the movement of the paddle which, in turn, resists movement of the belt. The amount of resistance to belt movement is a function of the speed of movement of the belt and the size of the paddle which is designed to be readily changed as desired. The paddle may include means for varying the pitch of the paddle(s). The paddle may also be used in combination with numerous other types of underwater exercise apparatus such as, for example, a bicycle type apparatus.

11 Claims, 6 Drawing Sheets

APPARATUS FOR UNDERWATER EXERCISE

BACKGROUND OF THE INVENTION

This invention relates to apparatus for underwater exercise and particularly to means for providing resistance to movement of a user's limbs, e.g. resistance to the movement of a treadmill driven by a user's legs.

The use of exercise apparatus disposed within a body of water, for reducing gravitational stresses on the user's body, are known. While not restricted thereto, the present invention has particular utility in underwater exercise treadmills of the type shown in U.S. Pat. Nos. 4,576,376, 4,712,788, 4,776,581, 3,485,213, and 4,332,217, the subject matter of these patents being incorporated herein by reference. U.S. Pat. Nos. 3,485,213 and 4,332,217 show the use of a treadmill placed in a liquid filled container for exercising animals. U.S. Pat. Nos. 4,576,376, 4,712,788 and 4,776,581 show treadmill and/or cycle type underwater exercise apparatus for use by humans. The above identified patents are of interest, but not one of them discloses a simple mechanism for increasing or varying the resistance to movement of the user's limbs.

This is best explained with reference to the above cited U.S. Pat. No. 4,576,376 to Miller which shows a treadmill which operates a water pump for the purpose of providing resistance to movement of the treadmill belt for increasing the effort of moving the belt (as by walking or jogging thereon) by the user. Means, controllable by the user, are also provided for variably restricting the pump output for selectively varying the resistance to movement of the belt.

A problem with this particular treadmill arrangement is its relative complexity and attendant high cost and weight (the latter being of importance with respect to moving and repairing the apparatus in an underwater environment).

Also, the pump apparatus, and particularly the gearing mechanism described in the patent for driving the pump from the treadmill, is subject to wear and corrosion, particularly within a body of water likely to be chlorinated.

Furthermore, the pump output varying means, for selectively varying the resistance to movement of the belt, while a desirable feature, is somewhat awkward to use, generally requiring a period of trial and error adjustment by the user until the desired resistance is obtained.

Still further, the water pump mechanism is relatively complex, requiring pipes and a valve assembly. Therefore, the resistance controlling mechanism disclosed in U.S. Pat. No. 4,576,376 tends to be complex and expensive.

In sharp contrast thereto, Applicants' invention is directed to a resistance controlling mechanism which is simple and inexpensive to manufacture and which lends itself to be easily adapted for use with many different types of exercise equipment.

SUMMARY OF THE INVENTION

Apparatus embodying the invention include a paddle means, comprised of one or more paddles, for use within a body of water. The paddle means is coupled to, or mounted on, an axle for rotation in the water in response to the rotation of the axle for providing resistance to the rotation of the axle.

In accordance with this invention, an underwater exercise apparatus is provided including a member to be moved by the user of the apparatus, the movable member being cooperatively coupled to an axle to cause rotation thereof. A paddle means is coupled to the axle for rotation therewith within the surrounding water. Hence, the movable member drives the paddle means which produces resistance to the movement of the member as the paddle rotates in the water.

The paddle means may also include means for varying the pitch of the paddle(s). Furthermore, the paddle means may include means for varying the number of paddles and/or the effective area of the paddles for varying the effective resistance to movement of the paddle means.

In one embodiment of the invention, a treadmill is provided adapted for underwater use, the treadmill comprising an endless belt disposed around a set of rollers. The belt is tightly coupled to one of the rollers, whereby resistance to rotation of the one roller causes a corresponding resistance to movement of the belt. To provide such resistance, the axle of the one roller is directly connected to a paddle means which rotates with the axle within the surrounding water. The water resists movement of the paddle means in proportion to the speed of movement thereof, and the resistance to movement of the paddle means provides a corresponding resistance to movement of the belt. Relatively large variations in resistance are obtained in response to relatively small variations in the speed of movement of the paddle means. Thus, the resistance to movement of the belt is readily altered by the user in response to relatively small changes in the rate of the user's movement along the belt. Thus, treadmills of the afore-described type, embodying the invention are considerably less complicated, expensive and heavy, easier to use and much less subject to wear and corrosion.

To accommodate different users of the apparatus, a simple attachment means may be provided to facilitate replacement or modification of the paddle means to provide different and selectively variable water resistance characteristics.

In another embodiment of the invention, e.g. an exercise bicycle, a paddle means is mounted on the axle of a bicycle pedal to rotate with the axle within the surrounding water; hence, to provide resistance to the pedaling of the bicycle.

DESCRIPTION OF PREFERRED EMBODIMENTS OF THE INVENTION

Figure 1:
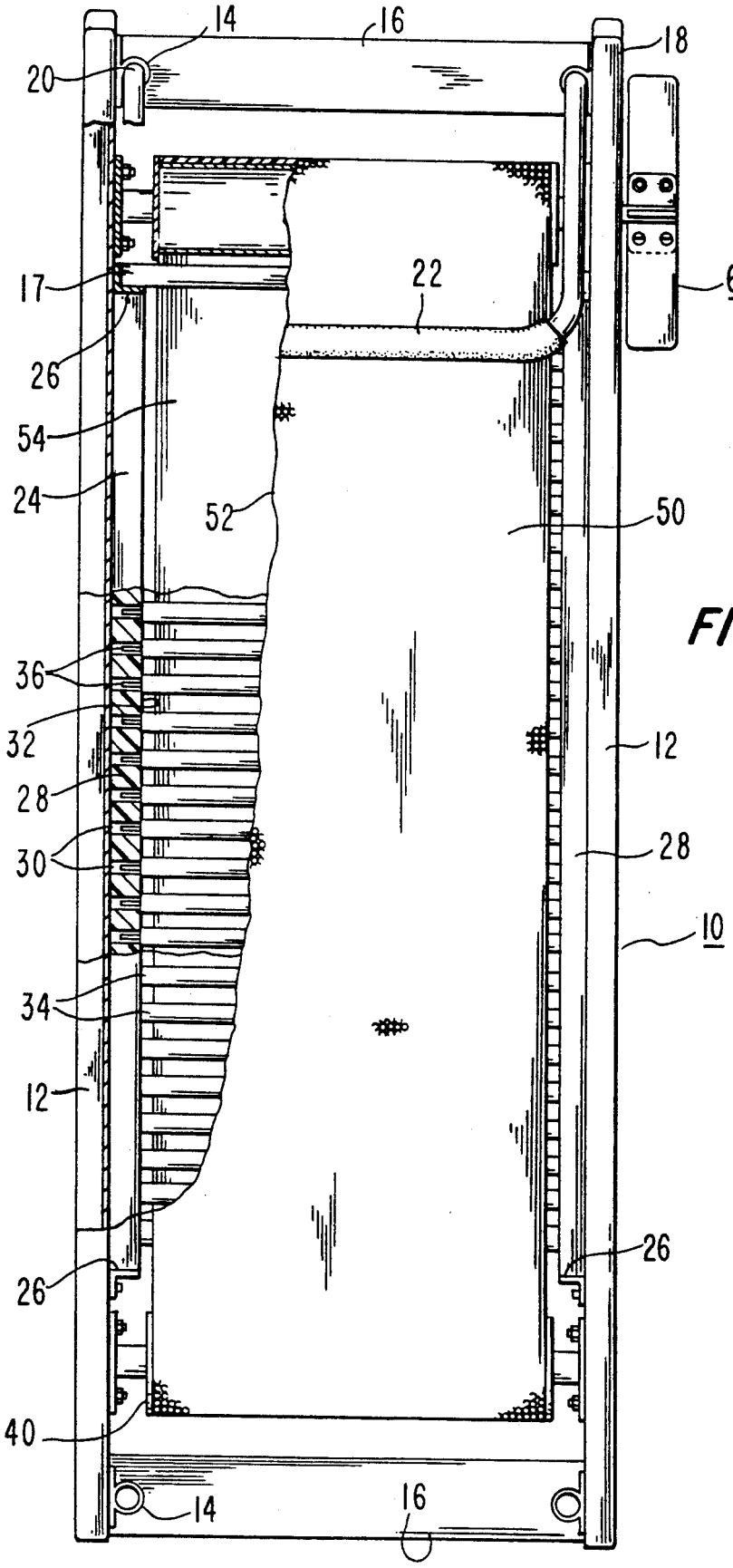
FIG. 1 is a plan view, partly broken away, of a treadmill according to this invention.
Figure 2:
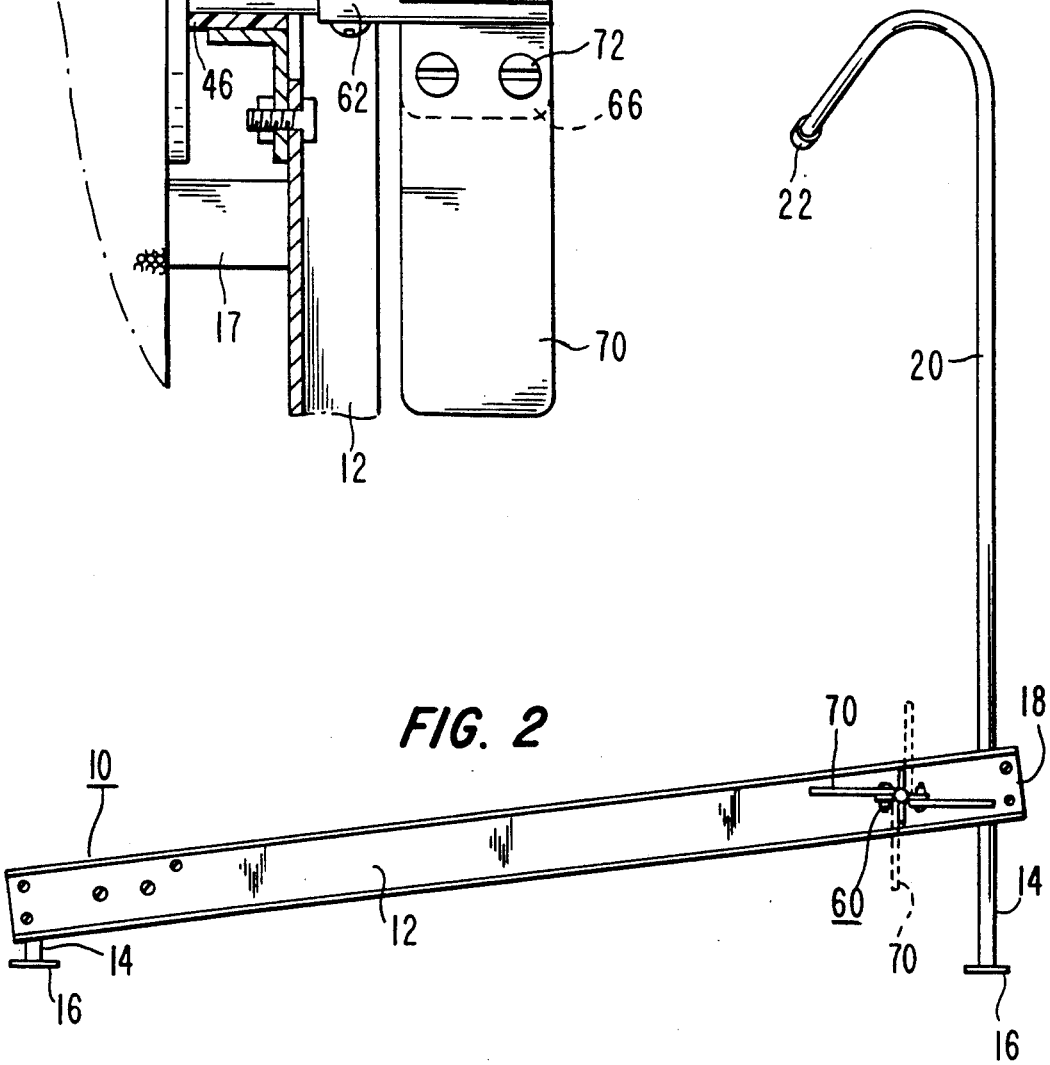
FIG. 2 is a side elevation of the treadmill shown in FIG. 1.

With reference to FIGS. 1 and 2, a treadmill 10 comprises a framework including a pair of elongated side members 12, each of channel shape for greater strength, and each mounted, at opposite ends thereof, on a pair of open ended tubular legs 14, as shown in FIG. 2. Referring back to FIG. 1, a flat plate member 16 extends between the side members at each end thereof on which the legs 14 are mounted, the plate members 16 serving the dual role of providing a unitary rigid framework for the treadmill and providing a relatively wide area support for the treadmill for preventing damage to the pool bottom surface supporting the treadmill. Additional strength for the framework is provided by a bar 17 extending between and secured to the side members 12 near one end 18 thereof.

At the end 18 of the framework is mounted a tubular frame, including a pair of vertical bars 20, the lower ends of which extend into the tubular legs 14, which provide support for the frame, and the other ends of which are interconnected by a horizontal bar 22, providing a hand grip for engagement by a user of the treadmill.

As shown in FIG. 1, each side member 12 includes an elongated ledge 24 which extends inwardly of the framework and towards the other of the side members 12, the ledges in each side member lying in a common plane. Mounted on each ledge 24, and positioned therealong by means of vertical walls 26 at each end of each ledge, is an elongated roller supporting bar 28 of generally square cross-section and preferably made of a rigid plastic material.

The bars 28 each contain a plurality of bores 30 spaced along the elongated axis of the bars and extending into the bars from the inwardly facing surfaces 32 thereof. The axis of each bore 30 is perpendicular to the bar surface 32, and each bore 30 on each bar 28 is in axial alignment with a corresponding bore 30 on the other of the bars 28.

Disposed between the bars 28 are a plurality of identical rollers 34. Each roller 34 comprises a hollow, closed ended cylinder having an axial pin 36 extending through the roller and exiting from the roller through central openings through the cylinder end surfaces. The cylinder pins 36 are lossely received in each of a pair of coaxial bores 30 in the bars 28, all the rollers thus being rotatably supported by the bars 28 with the axes of the rollers 34 lying in a common plane.

Figure 3:
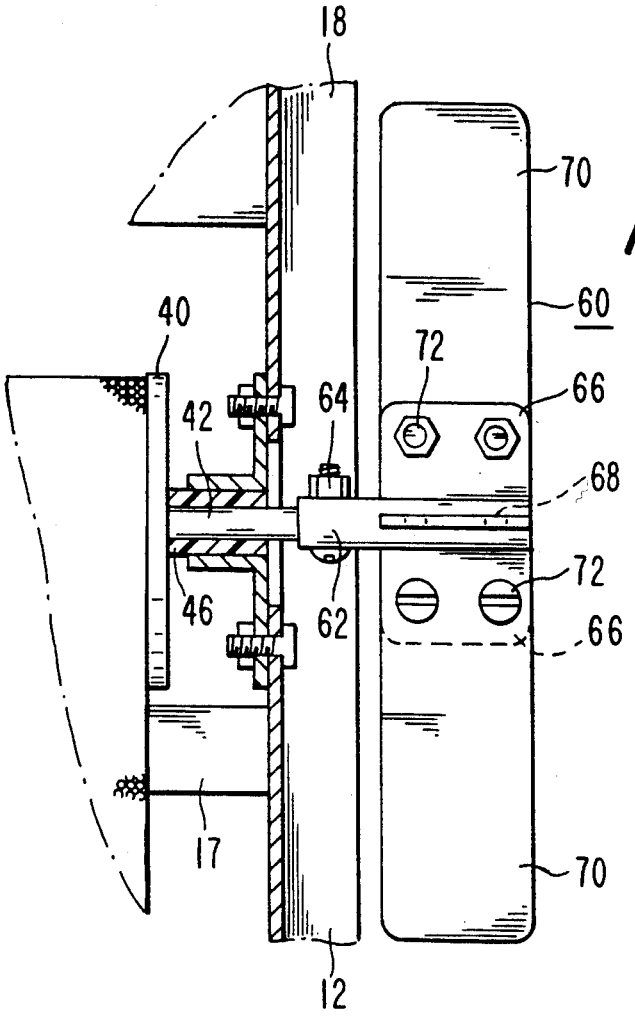
FIG. 3 is a plan view, on an enlarged scale and partly broken away, of the inventive paddle means shown in FIG. 1.

Two additional rollers 40, preferably identical to each other, are provided, one at each end of the set of rollers 34 and parallel thereto. The rollers 40 comprise hollow cylinders, the ends of which are closed by circular plates providing end flanges for the cylinders. Axial pins 42, as shown in FIG. 3, extend through the cylinders and outwardly of the cylinder end plates. Coaxial bushings 46 (as shown in FIG. 3) are mounted on each end of the elongated side members 12, and the cylinder pins 42 extend loosely into the bushings for rotatably supporting the rollers 40.

As shown in FIG. 1, the roller 40 cylinders have a greater diameter than the diameter of the cylinders of the rollers 34. To provide a planar support of the treadmill belt (described hereinafter), the radially uppermost surface portion of the roller 40 cylinder lies in the plane defined by the radially uppermost surface portions of the roller 34 cylinders. To accomplish this, the bushings 46 are disposed on the side members 12 so that the axes thereof are disposed slightly below the plane defined by the axes of the roller 34 mounting bores 30.

An endless belt 50 is wound relatively tightly around the rollers 40 and provides the moving surface for the support of a user of the treadmill.

The upper course 52 of the belt rests on the uppermost surfaces of all the rollers 34 and 40, which provides firm support for the belt. The rollers 34 are spaced sufficiently close together, e.g. 1.5 inches between centers, and the belt 50 is sufficiently rigid and tensioned to provide a relatively flat surface for the user.

Owing to the difference in diameters between the rollers 40 and the rollers 34, the lower course 54 of the belt passes freely beneath the rollers 34 without touching them. The tension on the belt is thus determined by the fit of the belt around the two end most rollers 40, slot means being provided whereby at least one pair of bushings 46 can be moved for varying the distance between the rollers 40 to obtain the desired belt tension. The significane of this is that there is thus provided a firm contacting of the belt 50 with the rollers 40 which thus rotates in direct synchronization with movements of the belt.

As mentioned above, means are provided for varying the resistance to movement of the belt in proportion to the speed of the belt. Such means, previously referred to as a paddle means, is now described.

As shown in FIG. 3, the axial pin 42 of the roller 40 at the front end 18 of the treadmill extends entirely through its mounting bushing 46 and laterally beyond the side member 12. Directly mounted on the extending end of the pin 42 for rotation therewith about the pin axis is a paddle means. The paddle means 60 comprises a hollow cylinder 62 telescoped onto the pin 42 and removably secured thereto by means of a screw and nut 64. Secured to the cylinder 62, as by welding, are four radially extending plates 66, the plates 66 being equally spaced around the cylinder 62. Each plate 66 is provided with a pair of holes 68 therethrough by means of which an extending paddle 70 can be removably secured to the plate by means of screws and nuts 72.

In the embodiment shown, two paddles 70 are shown attached one each to each of two plates 66. Additional paddles 70 can be added, as desired, such as shown in phantom in FIG. 2, to increase the resistance to movement of the belt 50. Also, longer or shorter, or wider or narrower paddles can be used, as desired, to obtain the desired resistance to movement characteristic.

In use, the treadmill 10 is disposed within a pool of water of any convenient depth, e.g. from 2 to 6 feet. The length of the treadmill legs 14 are such that the lower portion of the treadmill and particularly the paddle means 60, is completely submerged. (In one embodiment, the legs 14 at the front end 18 of the treadmill are 9 inches long while the legs 14 at the back end are 3 to 6 inches high, the plane of the belt 50 thus being slightly inclined to cause the mover to be ever moving slightly "uphill".)

The user grasps the horizontal handle 22 and walks or jogs along the belt 50 which moves backward in response to the forward-like movement of the user. The moving belt 50 causes rotation of all the various rollers and, because of the tight fit of the belt around the rollers 40, rotation of the rollers 40 is in direct synchronization with the belt movement. Rotation of the forward end roller 40 causes rotation of the paddle means 60 attached thereto. Such rotation is resisted by the surrounding water which, because of the tight coupling between the roller 40 and the belt 50, provides resistance to movement of the belt.

It is found that relatively small increases in the speed of movement in the belt result in relatively large increases of belt movement resistance. Each user can therefore exercise at a desired resistance level determined by the rate at which the user walks or jogs on the treadmill. Thus, a feature of the invention is that, in general, the same paddle means can be used by different users of the apparatus with their different exercise needs being accommodated by their different rates of movement.

A feature of the invention is that it allows for different paddle means to be used by different users. Thus, for a given user, a paddle means configuration can be selected, on a trial and error basis, which provides the desired resistance at the desired speed of movement, and such configured paddle means (with a certain number of paddles 70 of a certain size) can be readily mounted on the treadmill each time that the particular user uses it. Thus, while a trail and error process may be used to arrive at a preferred paddle means configuration, once selected, the same paddle means configuration can be used immediately upon subsequent uses of the treadmill by that particular user.

In one embodiment of the invention, the rollers 40 have a diameter of four (4) inches. The plates 66 of the paddle means 60 are two (2) inches wide (along the axis of the cylinder 62) and one (1) inch long. The paddles 70 are two (2) inches wide and four and one half (4.5) inches long. The dimensions are not critical and, as explained, paddles of different lengths are usable as desired.

The materials of the treadmill are preferably stainless steel and plastic to minimize corrosion. The plastic bars 28 are a particularly inexpensive and convenient means of mounting the rollers 34. The bushings 46 (for the rollers 40) are also of plastic.

In treadmills embodying the invention, resistance is provided by resistance to the movement of the user's limbs, and particularly the lower limbs, in the water and by resistance to movement of the mechanically operated paddle mechanism. These factors combine effectively to increase the resistance in proportion to the speed of movement of the user. This contrasts to motor driven treadmills where the user must match the predetermined speed of the equipment and to non-motorized treadmills where the resistance to movement is independent of the speed of movement.

Thus, the combination of the paddle mechanism and the treadmill enable a wide range of resistance to movement to be produced in a simple manner with a high degree of economy in cost and space.

Figure 4:
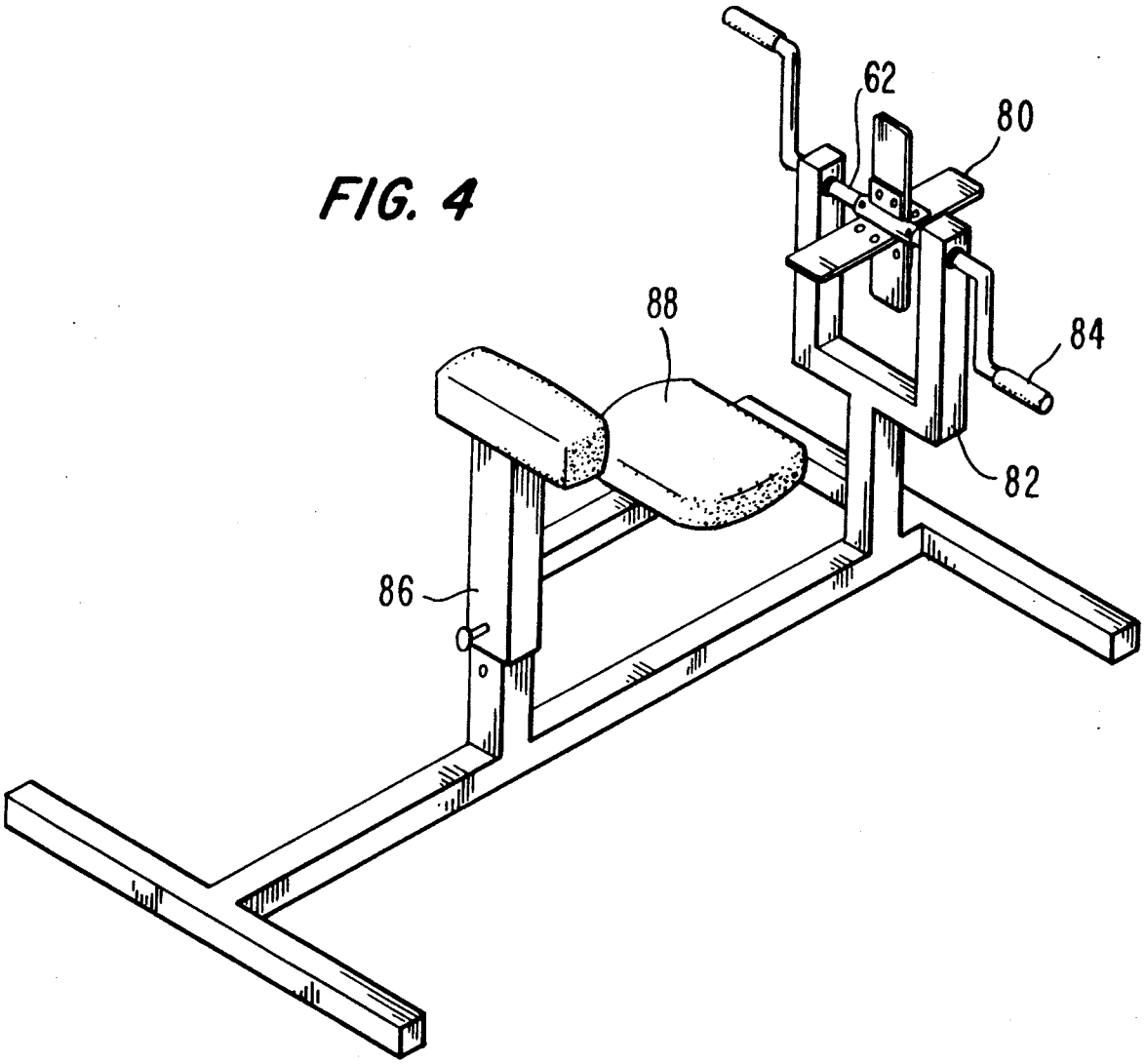
FIG. 4 is a side view of a portion of an exercise bicycle showing a paddle means, in accordance with this invention, mounted on the axle of one of the bicycle pedals.

The invention is not limited to treadmill exercise apparatus. For example, as shown in FIG. 4, the paddle mechanism can be used in a "bicycle" exercise apparatus in which the usual type wheel is directly replaced by a paddle means 80 substantially identical to the paddle means 60 shown in FIG. 3. In perhaps the simplest embodiment, the hollow cylinder 62 of the paddle means 80 serves as the inner hub of the "bicycle" wheel and conventional bicycle wheel support 82 and pedal means 84 are used to support and drive the paddle means "wheel" within a water environment.

The chair is designed to enable the user of the chair to raise or lower the height of the chair's seat 88 and back 86. The user can thereby submerge his upper limbs until the water level is at his mid-neck. Such a setting allows the water to support the weight of the user's upper limbs (e.g. arms and shoulder) and greatly reduces the exercising stress. This facilitates the therapeutic use of the underwater exercise equipment as practiced in Dr. Abboudi's clinic.

The pedal means 80 can be rotated by a user's feet or arms as desired. In the embodiment shown in FIG. 4, the mechanism is operated by a user's arms. Preferably, the paddle means 80 is enclosed by a wire cage (not shown) for safety reasons. By tilting the chair mechanism backward, the back 86 and seat 88 can be positioned so that the pedal means can be driven by the user's feet.

It is evident from the example above that the paddle means of the invention lends itself to be combined, by mounting or coupling, with numerous types of exercise equipment to produce resistance which increases with the increasing rotational speed of the axle on which the paddle means is mounted.

Figure 5:
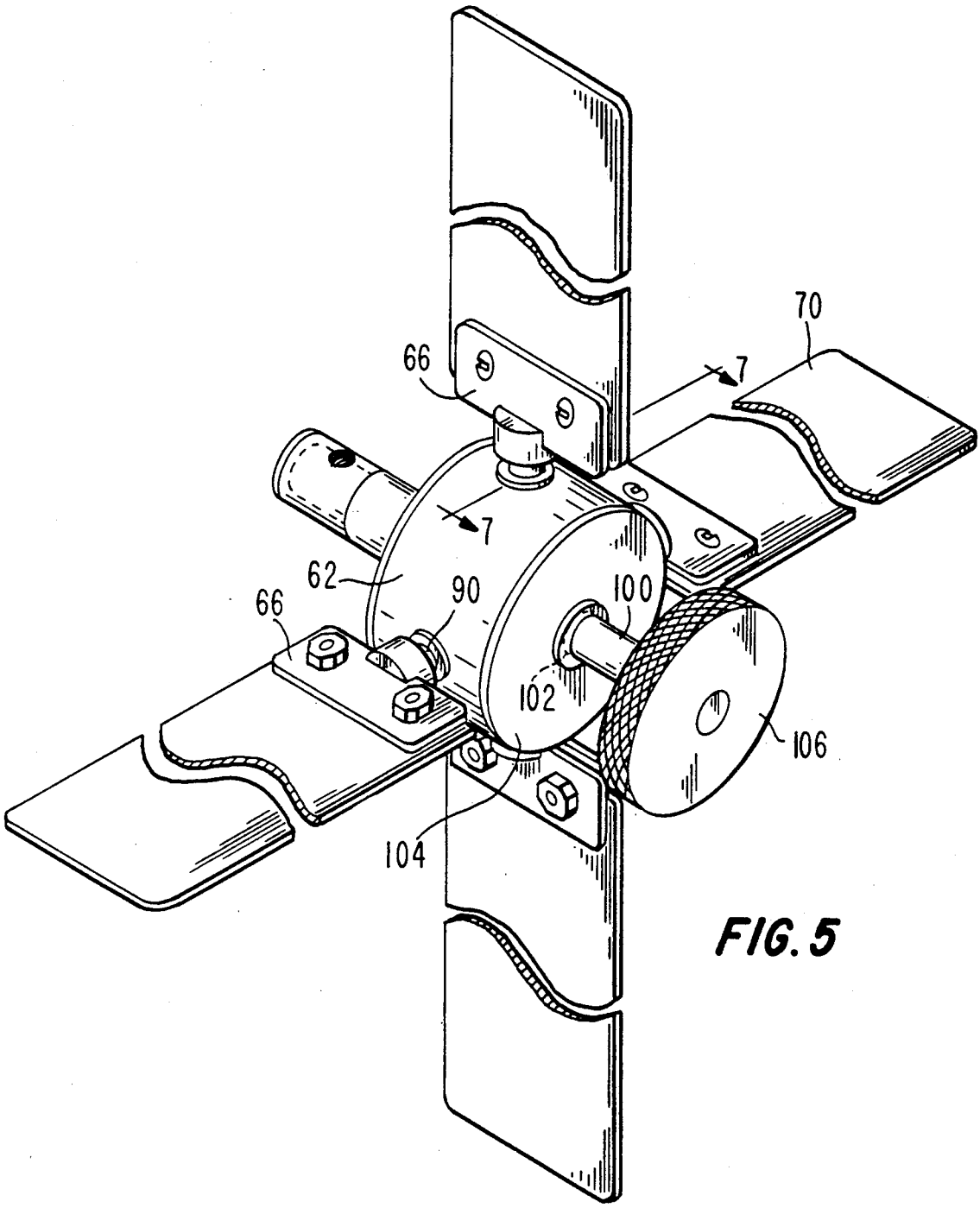
FIG. 5 is a perspective view of a variable pitch paddle means embodying the invention.
Figure 6:
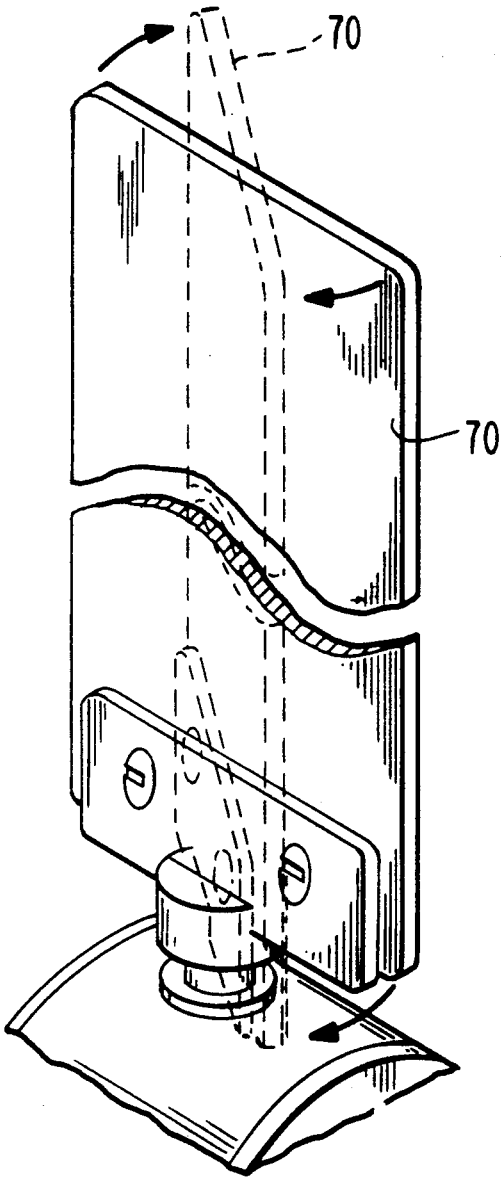
FIG. 6 is a drawing showing the change of the pitch of a paddle.
Figure 7:
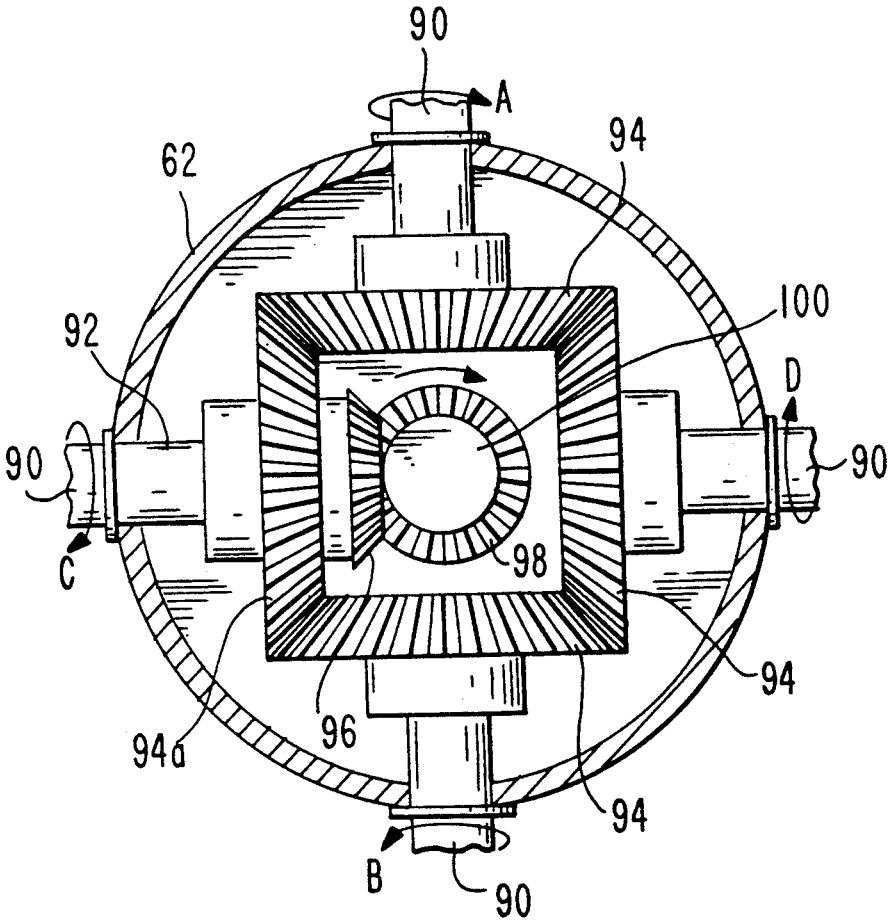
FIG. 7 is a cut-away view of a gear mechanism used to change the pitch of the paddles in the paddle means of FIG. 5.

FIGS. 5–7 show an arrangement whereby the pitch of each of the paddles 70 can be changed for altering the resistance to movement of the paddle means 60 (FIG. 3) or 80 (FIG. 4) through the water.

As shown in FIGS. 6 and 7, the cylinder 62 on which are mounted the plates 66 is made somewhat larger than in the paddle means shown in FIGS. 3 and 4 and each plate 66 is mounted, for selected angular orientation, on a rod 90 which extends into the cylinder 62 through a bushing 92 (FIG. 7). Within the cylinder 62 (FIG. 7) each rod is connected to a beveled gear 94 which is meshed with two adjacent bevel gears of the adjacent rods 90. One of the rods 90 (the left-hand one shown in FIG. 7) extends through its gear **94*a* and terminates in an additional beveled gear 96. The gear 96 is meshed with a beveled gear 98 which is mounted on a rod 100 passing through an opening 102 (FIG. 5) through an end wall 104 of the cylinder 62. The rod is terminated outside the cylinder 62 with a knob 106. Means, such as C-rings 102 are mounted on the rod 100** on either side of the wall to anchor the rod in place.

In use, by turning the knob 106 (shown in FIG. 5), the gear 98 mounted on the rod 100 is rotated which causes rotation of the gear 96. This, in turn, causes rotation of the gear **94*a* and a corresponding rotation of each of the meshed gears 94. The gears 94 rotate the rods 90, which rotate the plates 66, thereby changing the pitch of the paddles 70 as shown in FIG. 6**. By varying the pitch of the paddles, the resistance to movement of the paddle means through the surrounding water is varied.

It should be noted that the particular means for varying the pitch of the paddles, shown in FIG. 7, includes means for varying the pitch of a first paddle (i.e. on one side of the cylinder) a selected number of degrees (0 to 90 degrees) in one direction (e.g. clockwise) and the pitch of the paddle opposite the first paddle (i.e. on the other side of the cylinder) the same number of degrees but in the opposite direction (e.g. counterclockwise). This is illustrated by the directional arrows A and B for the paddles lying in the vertical plane and directional arrows C and D for the paddles lying in the horizontal plane. The advantage of this system of alternate directional rotation of the paddles is that it results in providing a neutral propulsive effect in the water and equal resistance to movement in the water in either direction (e.g. forward or reverse) of rotation. This contrasts to boat or airplane propeller mechanisms which, although they include pitch varying means, do so in a manner to provide a propulsive effect in a forward or backward manner.

It has thus been shown that the paddle mechanism of the invention may include means for varying the pitch of the paddles to thereby vary the effective resistance of the paddle means as it is being rotated in the water.

What is claimed is:

1. A treadmill submergeable in a body of water for enabling therapeutic exercise to be performed underwater, said treadmill comprising a frame for maintaining the treadmill in a stationary position on the bottom of the body of water, an endless belt wound around a plurality of rollers, and a paddle means directly connected to one of said rollers for movement through the water in response to the rotation of said one roller in response to the movement of said belt in proportion to the speed of movement thereof, said one roller including an axle extending laterally beyond a side edge of said belt, said paddle means including a radially extending paddle member mounted on said axle beyond said side edge of said belt and for rotation therewith, and at least a portion of said frame extending lower than said paddle member for maintaining said paddle member above the bottom of the body of water.

2. A treadmill according to claim 1 including a paddle member mounting means disposed around said axle and including a plurality of circumferentially spaced paddle attachment means allowing a selected, variable, number of paddle members to be attached to said mounting means.

3. A treadmill according to claim 1 including an elongated framework including a pair of parallel side members each including an elongated ledge extending inwardly of said framework towards the other of said side members, an elongated roller support bar of a rigid plastic material disposed on each of said ledges, each of said bars containing a plurality of bores spaced apart along the axis of elongation of said bars, each of the bores in one of said bars being axially aligned with a corresponding bore in the other of said bars, and each end of first ones of said rollers including an axially extending pin, the axial pins of each of said first rollers being loosely received within respective ones of a pair of coaxial bores for rotatably supporting each of said first rollers.

4. A treadmill according to claim 3 including a pair of horizontally aligned bushings disposed at each end of said framework, each bushing of each said pair being disposed on a different one of said side members beyond the end of said bar thereon and at a height to position the bushing axis below said bar axis of elongation, a pair of second rollers of larger diameter than said first rollers mounted one each horizontally between each pair of said bushings, the radially uppermost surface portions of all of said first and second rollers lying within a common plane, an axle of one of said second rollers extending through its supporting bushing and beyond the side member containing said last mentioned bushing, and said means being mounted on the extending end of said axle.

5. The treadmill as claimed in claim 1 wherein said paddle means includes means for varying the pitch of said at least one paddle.

6. The treadmill as claimed in claim 5 wherein said paddle means includes at least two paddles disposed on either side of a central axis, and wherein said means for varying the pitch also includes means for varying the pitch of one of said two paddles a given number of degrees in one direction and the second of said two paddles the same number of degrees but in the opposite direction to said one direction.

7. The treadmill as claimed in claim 1 wherein said paddle means is directly mounted on said axle and said axle is directly coupled to said movable member.

8. The treadmill as claimed in claim 1 wherein said paddle means is mounted on and directly connected to said axle for rotation therewith, whereby, in use of said treadmill within said body of water, rotation of said paddle means within the water provides resistance to movement of said movable member.

9. The treadmill as claimed in claim 1 wherein said paddle means includes at least one paddle directly connected to said axle for causing said paddle means to rotate in response to the rotation of said axle, said paddle means providing resistance to movement of said movable member when said paddle means is disposed within a body of water.

10. The treadmill as claimed in claim 1 wherein the portion of said frame extending lower than said paddle member includes legs supporting the rest of the frame.

11. The treadmill as claimed in claim 1 wherein the portion of said frame extending lower than said paddle member includes support means connected to and supporting said frame.

* * * * *